US005493173A

United States Patent [19]

Imura

[11] Patent Number: 5,493,173

[45] Date of Patent: Feb. 20, 1996

[54] FIELD EMISSION COLD CATHODE AND METHOD FOR MANUFACTURING THE SAME

[75] Inventor: Hironori Imura, Tokyo, Japan

[73] Assignee: NEC Corporation, Tokyo, Japan

[21] Appl. No.: 255,723

[22] Filed: Jun. 7, 1994

[30] Foreign Application Priority Data

Jun. 8, 1993 [JP] Japan ..... 5-137058

[51] Int. Cl.[6] ..... H01J 19/38

[52] U.S. Cl. ..... 313/306; 313/308; 313/309; 313/351

[58] Field of Search ..... 313/306, 308, 313/309, 336, 351; 315/169.4; 345/75

[56] References Cited

U.S. PATENT DOCUMENTS

| | | | |
|---|---|---|---|
| 5,075,591 | 12/1991 | Holmberg | 313/309 X |
| 5,164,632 | 11/1992 | Yoshida et al. | 313/309 |
| 5,229,682 | 7/1993 | Komatsu | 313/309 |

OTHER PUBLICATIONS

C. A. Spindt, I. Brodie, L. Humphrey, and E. R. Westerberg, "Physical Properties of Thin–Film Field Emission Cathodes with Molybdenum Cones", 5–137058, Journal of Applied Physics, vol. 47, No. 12, (1976), Stanford Research Institute, Menlo Park, California 94025.

Henry G. Kosmahl, "A Wide–Bandwidth High–Gain Small–Size Distributed Amplifier with Field–Emission Triodes (Fetrode's) for the 10 to 300 GHz Frequency Range", IEEE Transactions of Electron Devices, vol. 36, No. 11, Nov. 1989.

Komatsu, "Manufacture of Field Generating Electrode," Japanese Patent Laid–Open Publication No. 3–71529 (Mar. 27, 1991).

Fujinami, "Electron Gun," Japanese Patent Laid–Open Publication No. 57–187849 (Nov. 18, 1982).

*Primary Examiner*—Sandra L. O'Shea
*Assistant Examiner*—Ashok Patel
*Attorney, Agent, or Firm*—Popham, Haik, Schnobrich & Kaufman, Ltd.

[57] ABSTRACT

A field emission cold cathode includes a conductive substrate, an insulating layer formed on the substrate and having plural cavities each for receiving an emitter, a gate electrode for applying a high electric field to the tips of emitters. An annular portion of the gate electrode defines an opening of a corresponding cavity is located at a distance from the substrate smaller than the distance between an elevated middle portion of the gate electrode and the substrate. Parasitic capacitance between the gate electrode and the cold cathode including the substrate and the emitter is reduced due to the large distance between the elevated middle portion of the gate electrode and the substrate. Between the elevated middle portion and the substrate, a second insulating layer or a gap is disposed. The field emission cold cathode can function in a high frequency range while fabricating conical emitters with a small height due to the small distance between the annular portions and the substrate.

5 Claims, 6 Drawing Sheets

FIELD EMISSION COLD CATHODE AND METHOD FOR MANUFACTURING THE SAME

BACKGROUND OF THE INVENTION (a) Field of the Invention

The present invention relates to a field emission cold cathode and a method for manufacturing the same. More particularly, it relates to a field emission cold cathode having a reduced parasitic capacitance between a cold cathode and a gate electrode, and a method for fabricating such a field emission cold cathode.

(b) Description of the Related Art

C. A. Spindt et al. have made an experimental field emission cold cathode having a thin-film structure formed on a silicon substrate by micro-machining using an LSI fabricating techniques (Journal of Applied Physics, Vol. 47, No. 12, 1976). FIG. 1 is a sectional view showing the structure of the cold cathode as described by Spindt et al. An insulating layer 2 having a thickness of 1 μm and a gate electrode 3 made of molybdenum are formed consecutively on a silicon substrate 1. Cavities each having a diameter of about 1.5 μm are formed in the insulating layer 2 for receiving emitters 4 and openings corresponding to the cavities are formed in the gate electrode 3. Each of the conical emitter 4 made of molybdenum is formed in a height of about 1 μm in corresponding one of the cavities so as to make ohmic contact with the silicon substrate 1.

When a voltage ranging from a few tens of volts to 200volts is applied between the silicon substrate 1 and the gate electrode 3 such that the gate electrode 3 has a positive potential, an electric field of $10^7$ V/cm or more is generated at the tip of each emitter 4, the electric field permitting the tip of each emitter 4 to emit electrons to an anode disposed opposite the cold cathode. The conical shape of the emitter causes a difficulty in obtaining a large height thereof, hence, a field emission cold cathode has a small distance between the substrate 1 and the gate electrode 3.

The electron emission of 100 μA or more per an emitter was observed by a recent experiment, and various applications of the field emission cold cathode have been proposed. Examples of the proposed applications include a switching device using a micro-triode in which a field emission cold cathode having a thin film structure is employed as an electron source, and a display panel on which a fluorescent material is made luminous by electrons emitted by a flat emission source including a plurality of emitters of a cold cathode arranged in a matrix.

In a field emission cold cathode as described above, however, a parasitic capacitance is generated between the cold cathode including tile substrate 1 and the gate electrodes 3. The parasitic capacitance is increased because of the small distance between the substrate 1 and the gate electrode 3 as well as the enlarged area of the gate electrode including the bonding area and wiring area therefor. When a high frequency voltage is applied between the substrate 1 and the gate electrode 3, the impedance between the substrate 1 and the gate electrode 3 is lowered because of the presence of the large parasitic capacitance, thereby degrading the function of the field emission cold cathode in a high frequency range when applied in a switching device or display panel.

SUMMARY OF THE INVENTION

In view of the foregoing, it is an object of the present invention to provide a field emission cold cathode having a small a parasitic capacitance and operable in a high frequency range.

A field emission cold cathode according to the present invention comprises a substrate having an electric conductivity at least in a main surface thereof, an insulating layer formed on the main surface of the substrate and having a substantially uniform thickness, the insulating layer having a cavity therein, a gate electrode formed overlying the insulating layer and having an annular portion defining therein an opening at least partially overlapping the cavity, the annular portion being located at a distance from the main surface smaller than the distance of an elevated middle portion adjacent to the annular portion from the main surface, an emitter disposed in the cavity and electrically connected to the main surface, the emitter having an emission tip disposed adjacent to the annular portion.

A method for manufacturing a field emission cold cathode according to the present invention in a first aspect including steps of: forming a first insulating layer on a conductive main surface of a substrate; forming a second insulating layer on the first insulating layer; forming in the first insulating layer at least one opening exposing the main surface and in the second insulating layer a second opening exposing the first opening and an annular surface of the first insulating layer, the annular surface defining the first opening therein; forming a gate electrode layer on the second insulating layer and on the annular surface; and forming on the main surface in the opening an emitter having an emission tip disposed adjacent to the second opening.

A method for manufacturing a field emission cold cathode according to the present invention in a second aspect includes steps of: forming an insulating layer on a conductive main surface of a substrate; forming a sacrificial layer on the insulating layer; forming in the sacrificial layer at least one aperture exposing the insulating layer; forming in the insulating layer a first opening exposing the main surface and in the sacrificial layer a second opening exposing the first opening and an annular surface of the insulating layer; forming a gate electrode on the sacrificial layer and on the annular surface; forming on the main surface in the first opening an emitter having an emission tip disposed adjacent to the second opening; and removing the sacrificial layer through the aperture by etching.

In accordance with the present invention, the gate electrode has an annular edge portion disposed in a first distance from the main surface of the substrate and an elevated middle portion disposed in a second distance greater than the first distance from the main surface, hence, the parasitic capacitance between the gate electrode and the substrate is lowered to have a low impedance in a high frequency range, while the emission tip of the emitter, which is supplied with an electric field mainly from the annular edge portion of the gate electrode, can be disposed close to the substrate due to the small first distance, thereby facilitating an emitter forming step in a fabricating process of the field emission cold cathode without degrading the function of the field emission cold cathode in a high frequency range.

BRIEF DESCRIPTION OF THE DRAWINGS

The above and other objects, features and advantages of the present invention will be more apparent from the following description, taken in conjunction with the accompanying drawings in which.

DESCRIPTION OF THE PREFERRED EMBODIMENTS

The present invention will now be described by way of preferred embodiments thereof with reference to the accompanying drawings.

Figure 1:
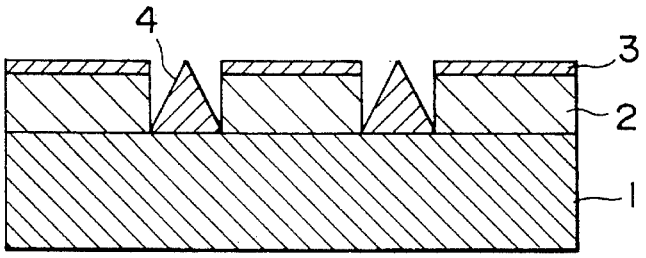
FIG. 1 PRIOR ART
FIG. 1 is a sectional view of a conventional field emission cold cathode.
Figure 2:
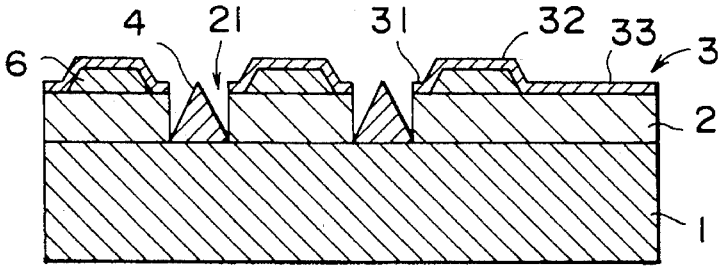
FIG. 2 is a sectional view of a first embodiment of a field emission cold cathode according to the present invention.
Figure 3:
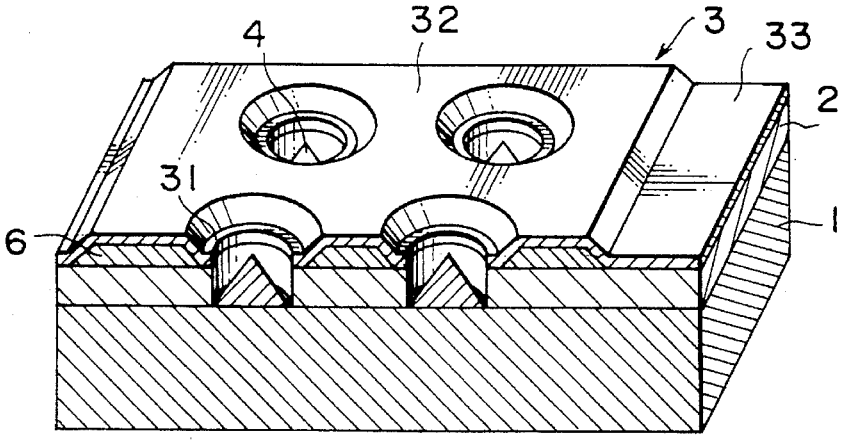
FIG. 3 is a sectioned perspective view of the field emission cold cathode of FIG. 2.

FIGS. 2 and 3 show a first embodiment of a field emission cold cathode according to the present invention. The field emission cold cathode comprises a substrate 1 made of highly conducting (0.01 Ω/cm, for example) silicon (Si), a first insulating layer 2 made of, for example, silicon oxide ($SiO_2$) and formed on the substrate 1, a second insulating layer 6 made of, for example, silicon nitride ($Si_3N_4$) and formed on the first insulating layer 2, a plurality of emitters 4 made of, for example, molybdenum (Mo) and formed in cavities 21, and a gate electrode 3 made of, for example, Mo and formed on the entire surface except the cavities 21. The thickness of the first insulating layer 2 is, for example, about 1 μm while the thickness of the second insulating layer 6 is, for example, about 0.5 μm. The gate electrode 3 and the emitters 4 can be made of other metal, preferably a metal having a high melting point. The first and the second insulating layers 2 and 6 may be made of any insulator.

The cavities 21 having a diameter of about 1.0 μm are formed in the first insulating layer 2 for receiving the emitters 4. The gate electrode 3 has an opening correspondingly to each of the cavities 21 for generating an electric field for the emitters, the opening being defined by an annular portion 31 of the gate electrode 3 with the inner edge of the annular portion being the periphery of the opening. The gate electrode 3 is formed on the first insulating layer 2 at the annular portions 31 and at the peripheral portions 32 of the gate electrode 3, while the gate electrode 3 is formed on the second insulating layer 6 at an elevated middle portion 32 thereof having a large area. Hence, each of the annular portions 31 and peripheral portions 33 of the gate electrode 3 is lower than the elevated middle portion 32 of the gate electrode 3 by about 0.5 μm, which is equal to the thickness of the second insulating layer 6. One of the peripheral portion 33 is formed for a bonding area at the lower position as shown in the drawing.

Each of the emitters 4 is of a conical shape having a base formed on the substrate 1 exposed at the bottom of the cavities 21 and having an ohmic contact with the substrate 1. Each of the emitters 4 is of a 1.2 μm height, and the tip of each emitter 4 is surrounded by the annular portion 31 of the gate electrode 3 and provided with an electric field mainly by the annular portion 31.

When a voltage ranging from a few tens of volts to 200 volts is applied between the substrate 1 and the gate electrode 3, an electric field of about $10^7$ V/cm or more is generated around the tip of each emitter 4, which permits the tip 4 to emit electrons and controls the emission current from the tip. The substrate 1 and the emitters 4 as coupled constitute a cold cathode emitting electrons toward an anode disposed opposite the cold cathode 1 and 4. With this configuration of the field emission cold cathode, the height of the emitter can be reduced while the parasitic capacitance between the cold cathode 1 and 4 and the gate electrode 3 can be reduced.

Figure 4A:
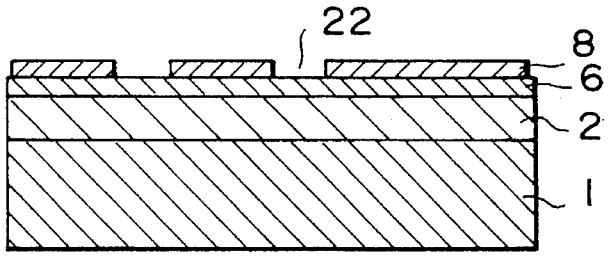
FIGS. 4A to 4F are sectional views showing successive steps of a first embodiment of a fabrication method according to the present invention.

FIGS. 4A to 4F show a first embodiment of a method for manufacturing a field emission cold cathode according to the present invention, the method being shown as fabricating the field emission cold cathode of FIGS. 2 and 3. A conductive substrate 1 of monocrystalline silicon is prepared. Then, as shown in FIG. 4A, a first insulating layer 2, a second insulating layer 6 and a photoresist pattern 8 are consecutively formed on the main surface of the Si substrate 1. The first insulating layer 2 is made of silicon oxide $(SiO)_2$ in a uniform thickness of about 1 μm and formed by a standard thermal oxidation technique, CVD or the like. The second insulating layer 6 is made of silicon nitride ($Si_3N_4$) having a uniform thickness of about 0.5 μm and formed by, for example, CVD. The photoresist pattern 8 has a plurality of apertures or openings 22 corresponding to the cavities in which the emitter is to be disposed. The photoresist pattern 8 is obtained by a known photolithograpic technique. The diameter of each aperture 22 of the photoresist pattern 8 is about 1 μm.

Figure 4B:
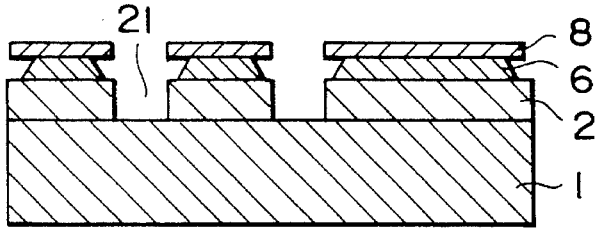
Figure 4C:
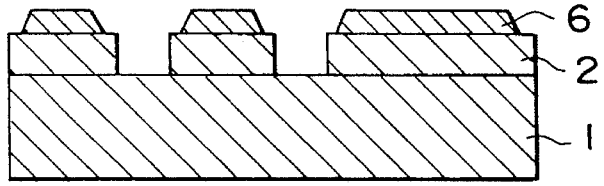
Figure 4D:
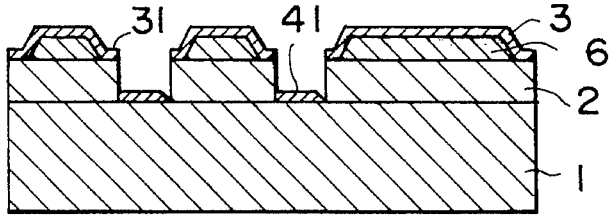

Next, a dry etching is effected to selectively etch the first and the second insulating layers 2 and 6 using the photoresist pattern as a mask, as shown in FIG. 4B. Alternatively, the second insulating layer 6 may be etched by a wet etching, while the first insulating layer 2 is etched by a dry etching. In this step, a side etching using an isotropic etching method is carried out under optimized conditions such that the diameter of each opening in the second insulating layer 6 is greater than a corresponding cavity 21 formed in the first insulating layer 2, and such that the diameter of the openings at a point in the second insulating layer 6 increases with the increase of the distance between the point and the substrate 1. In other words, each opening in the second insulating layer 6 is formed with a truncated corn, in which the diameter thereof is about 1.2 μm at the lower end contacting the first insulating layer 2 and about 1.4 μm at the upper end contacting the photoresist pattern 8. Then, the photoresist pattern 8 is removed as shown in FIG. 4C, hence, a structure is obtained in which the upper surface of the first insulating layer 2 is exposed, at annular portions thereof, from the opening of the second insulating layer 6.

Subsequently, a metal having a high melting point such as molybdenum is deposited on the entire surface including the annular portions of the first insulating layer 2 and the surface of the second insulating layer 6 by, for example, CVD or electron beam evaporation to form a gate electrode 3. The metal layer is also deposited at the bottom of each cavity so that a bottom layer 41 is formed in each cavity. The bottom layers 41 form base portions of the conical emitters 4 to be formed in a successive step.

Figure 4E:
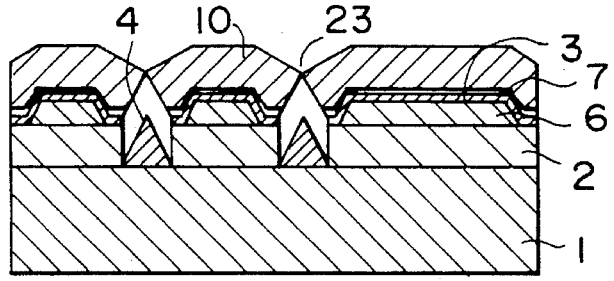

Then, as shown in FIG. 4E, aluminum is deposited by, for example, CVD at a grazed incidence so that a sacrificial layer or parting layer 7 is formed only on the gate electrode 3. The deposition of the sacrificial layer 7 is mainly carried out for facilitating the removal of a successive layer of, for example, molybdenum to be formed on the sacrificial layer 7. Subsequently, molybdenum is further deposited at normal incidence by, for example, CVD or electron beam evaporation from a small source to form a molybdenum layer 10 on the sacrificial layer 7 and to form conical emitters 4 on the bottom of the cavities 21. During this step, the size of the apertures 23 of the molybdenum layer 10 formed at the opening of the second insulating layer 6 continues to decrease because of the condensation of molybdenum on the periphery of the openings of the second insulating layer 6, as shown in FIG. 4E. Hence, a conical emitter 4 is formed inside each of the cavities 21 as the molybdenum vapor condenses thereby limiting the size of the aperture 23.

Figure 4F:
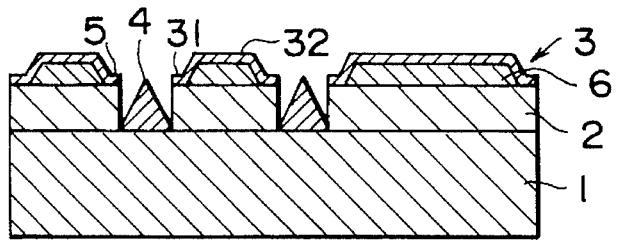

Subsequently, the sacrificial layer 7 of aluminium is dissolved by wet etching, thereby releasing the molybdenum layer 10 deposited on the sacrificial layer 7 during the emitter forming step. FIG. 4F is a sectional view of the field emission cold cathode as obtained. The distance between each annular edge portion 31 of the gate electrode 3 and the substrate 1 and the distance between the elevated middle portion 32 and the substrate 1 can be controlled independently of each other by selecting the thicknesses of the first and the second insulating layers 2 and 6. Therefore, the parasitic capacitance between the substrate 1 and the gate electrode 3 can be adjusted to have a low impedance on a high frequency range by employing the thickness of the second insulating layer 6 without degrading the function of the field emission cold cathode.

Figure 5:
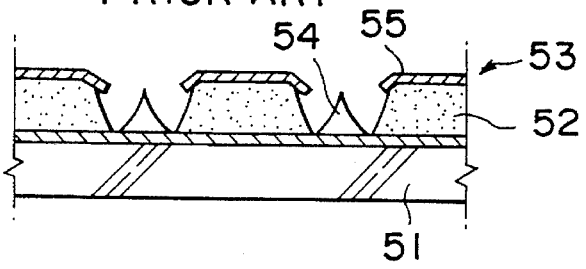
FIG. 5 PRIOR ART
FIG. 5 is a sectional view of another conventional field emission cold cathode.

Japanese Patent Laid-open Publication No. 3-71529 describes silicon-made emitters and insulating layers formed by a partially oxidizing method of silicon. FIG. 5 shows the configuration described in the publication, in which a gate electrode 53 is deformed so that the distance between the edge portions 54 of the gate electrode 53 surrounding cavities and the substrate 51 is smaller than the distance between the other portion 55 of the gate electrode 53 and the substrate 51. In this construction, however, the difference between the distances depends solely on the profile of the insulating layer 52 which is not uniform in thickness, so that the difference of the distances cannot be controlled. Futhermore, the difference amounts, for example, at most about 0.1 μm to 0.2 μm. Accordingly, with this structure, it is difficult to effectively reduce the parasitic capacitance between the gate electrode and the cold cathode without degrading the function of the field emission cold cathode.

Figure 6:
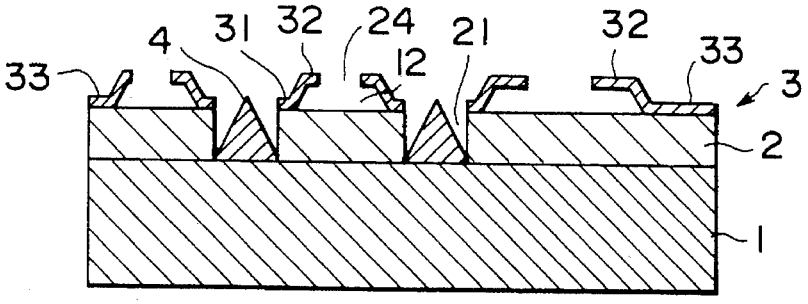
FIG. 6 is a sectional view of a second embodiment of a field emission cold cathode according to the present invention.
Figure 7:
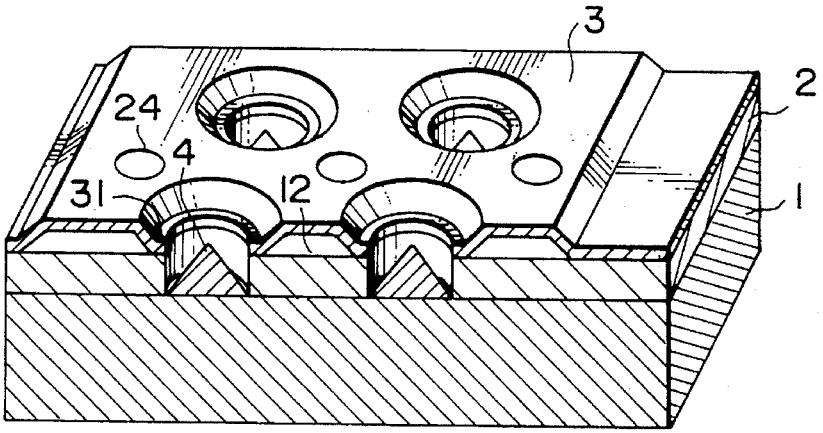
FIG. 7 is a sectioned perspective view of the field emission cold cathode of FIG. 6.

FIGS. 6 and 7 show a second embodiment of a field emission cold cathode according to the present invention. Similar elements are denoted by the same reference numerals in FIGS. 6 and 7 as in FIGS. 2 and 3. The field emission cold cathode of the second embodiment comprises a substrate 1 made of highly conducting silicon, an insulating layer 2 made of, for example, silicon oxide, a plurality of emitters 4 made of molybdenum, and a gate electrode 3 made of, for example, molybdenum. The insulating layer 2 has a uniform thickness of, for example, about 1 μm. The gate electrode 3 and the emitters 4 may be made of other metal, preferably a metal having a high melting point.

Cavities 21 having a diameter of about 1.0 μm are formed in the insulating layer 2 for receiving the emitters 4 therein. The gate electrode 3 has an opening corresponding to one of the cavities 21 and an annular portion 31 defining the opening by the inner edge thereof. The gate electrode 3 also has a plurality of small cut-outs 24 therein. The gate electrode 3 is formed on the insulating layer 2 at the annular portions 31 and at the peripheral portions 33 thereof, while it is formed above the insulating layer 2 at the elevated middle portions 32 thereof, with a gap or clearance 12 disposed between the elevated middle portion 32 of the gate electrode 3 and the insulating layer 2. The gap 12 is, for example, 0.5 μm or more. Hence, each of the annular portions 31 and peripheral portions 33 of the gate electrode 3 is lower than the elevated middle portion 32 having a large area by about 0.5 μm. The field emission cold cathode of this embodiment has a low parasitic capacitance between the gate electrode and the cold cathode due to the large distance between the elevated middle portion 32 of the gate electrode 3 and the substrate 1, so that effectively functions in a high frequency range without employing a large height of the emitters.

Figure 8A:
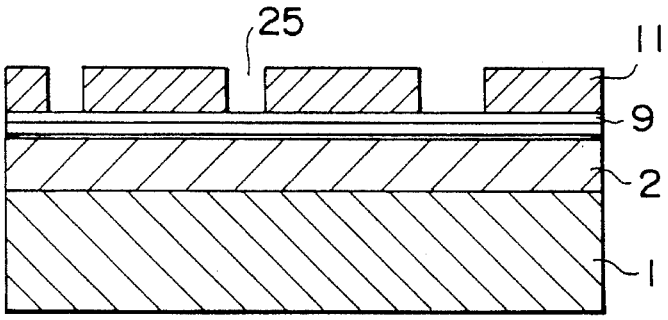
FIGS. 8A to 8H are sectional views showing successive steps of a second embodiment of a fabrication process according to the present invention.

FIGS. 8A to 8H show consecutive steps of a second embodiment of a method for manufacturing a field emission cold cathode according to the present invention, the method being used for fabricating the field emission cold cathode of FIGS. 6 and 7. Similar element in FIGS. 8A to 8H are denoted by the same reference numerals as those in FIGS. 4A to 4F. Referring to FIG. 8A, an insulating layer 2 having a thickness of about 1 μm is formed on a monocrystalline silicon substrate 1 by a standard thermal oxidation method. A first sacrificial layer 9 made of aluminum is formed on the insulating layer 2 in a thickness of about 0.5 μm. The first sacrificial layer 9 will be removed later to form a gap between the elevated middle portion 32 of gate electrode 3 and the insulating layer 2.

Figure 8B:
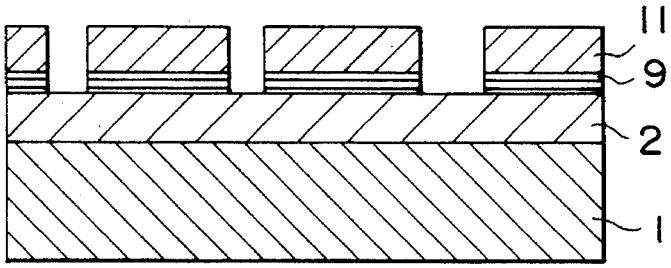

A first photoresist is coated on the first sacrificial layer 9, then exposed to light and soaked to form a photoresist pattern 11 in accordance with a known photolithographic technique. The first photoresist pattern 11 has apertures 25 at the locations corresponding to the cut-outs 24 (FIG. 6) in the gate electrode 3 to be formed. The diameter of each aperture 25 in the first photoresist pattern 11 is about 1 μm, which is enough for permitting an etchant to flow therethrough. Next, as shown in FIG. 8B, the sacrificial layer 9 is selectively etched by a dry etching method using the first photoreisist pattern 11 as a mask, thereby forming recesses in the first sacrificial layer 9, the bottoms of which reach the upper surface of the insulating layer 2. The first photoresist pattern 11 is then removed.

Figure 8C:
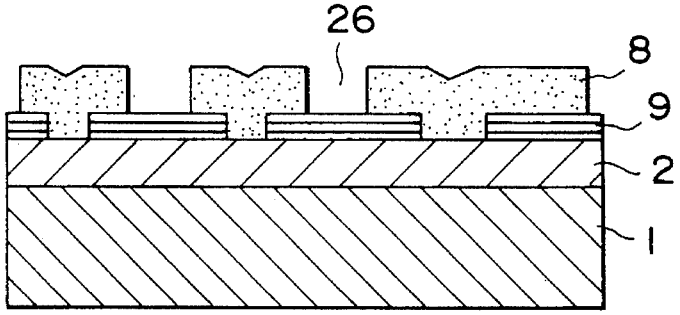
Figure 8D:
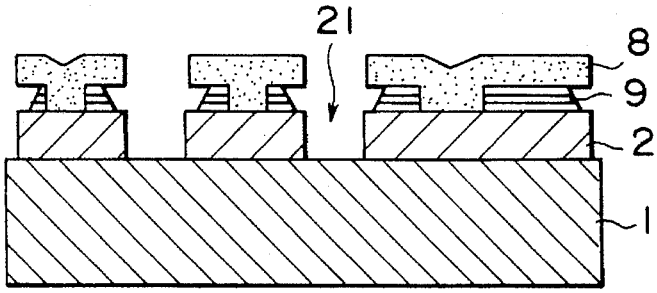
Figure 8E:
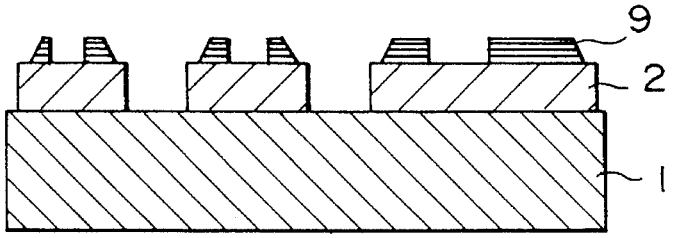

Subsequently, a second photoresist layer is coated on the first sacrificial layer 9, then exposed to light and soaked to form a second photoresist pattern 8 as shown in FIG. 8C. The second photoresist pattern 8 has apertures 26 at the location corresponding to cavities for emitters to be formed, the apertures 26 having a diameter of about 1 μm. Then, as shown in FIG. 8D, the insulating layer 2 and the first sacrificial layer 9 are selectively etched by dry etching to form cavities 21 in the first insulating layer 2 and openings in the first sacrificial layer 9 using the second photoresist pattern 8 as a mask. In this step, side etching using an isotropic etching method is carried out under optimized conditions such that the diameter of each opening in the first sacrificial layer 9 is greater than a corresponding cavity in the insulating layer 2, and such that the diameter of the openings in the first sacrificial layer 9 gradually increases with the increase of the height from the Si substrate 1. Namely, each of the openings in the first sacrificial layer 9 is formed with a truncated cone similar to that in the first embodiment. Next, the second photoresist pattern 8 is removed as shown in FIG. 8E.

Figure 8F:
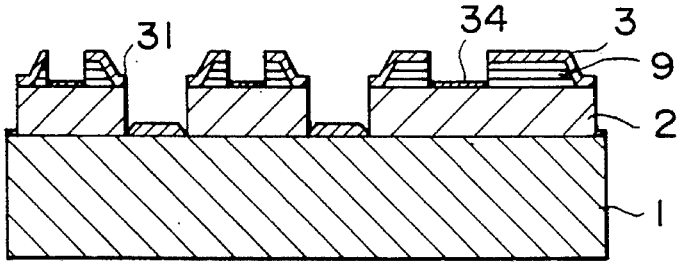
Figure 8G:
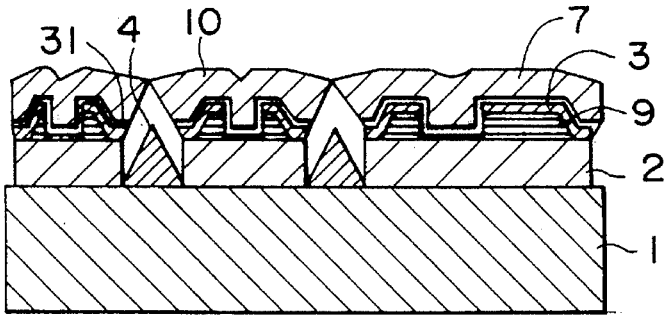
Figure 8H:
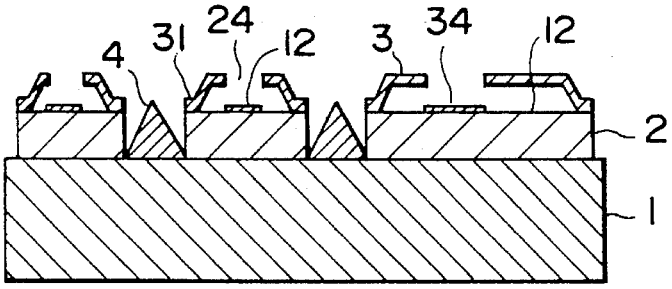

Subsequently, as shown in FIGS. 8F and 8G, a gate electrode 3, a second sacrificial layer 7, a molybdenum layer 10 and emitters 4 are formed in a manner similar to that as described before with reference to FIGS. 4D and 4E of the first embodiment. The difference between these embodiments is that the gate electrode 3 of the second embodiment has cut-outs 24 (FIG. 8H) at the location corresponding to the aperture 25 (FIG. 8A) of the first photoresist pattern 11. Then, as shown in FIG. 8H, the molybdenum layer 10 is removed by dissolving the second sacrificial layer 7 by a wet etching method using phosphoric acid, to obtain the cold cathode of FIGS. 6 and 7.

With the second embodiment of the method according to the present invention, when the gate electrode 3 is formed, a molybdenum layer 34 (FIG. 8F) is also deposited on the surface of the insulating layer 2 below each of the cut-outs 24 of the gate electrode 3. The molybdenum layers 34 below the cut-outs 24, however, cause little, if any adverse effect on the operation of the cold cathode of the present invention. In addition, if the fabrication process of the second embodiment is modified such that the step of forming the opening for selectively etching the first sacrificial layer 9 is performed after the step of forming the emitters 4, it is possible to avoid depositing of such a molybdenum layer 34.

Figure 9:
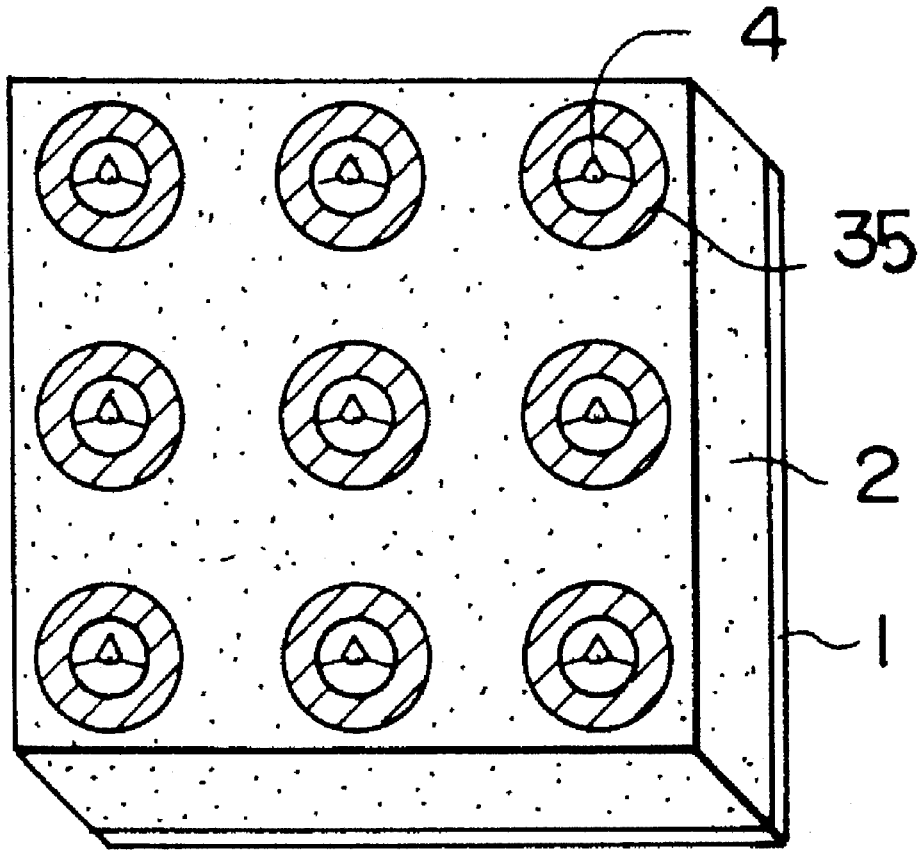
FIG. 9 PRIOR ART
FIG. 9 is a perspective view of a conventional cathode.

Japanese Patent Laid-open Publication No. 57(1982)-187849 shows a structure in which separate gate electrodes 35 are provided in a field emission cold cathode as shown in FIG. 9 of the accompanying drawings in the present application. The method in the publication employs a step for separating a gate electrode layer by selectively etching the gate electrode layer at the portions other than the cavities for receiving emitters 4, which step may be similar to the step of forming the cut-outs 24 of the gate electrode 3 in the second embodiment.

However, the gate electrode 35 of the cold cathode in the publication has a simple two-dimensional structure, as shown in FIG. 9. On the contrary, the gate electrode of the field emission cold cathode of the present embodiment has a three-dimensional structure, which is totally different from the structure in the publication. Moreover, in the final product of the field emission cold cathode of the present invention, the insulating layer is not exposed or is exposed only in small areas as compared to the structure in the publication, so that there is no or little risk that the charge of electron beams reflected from an anode disposed opposite the cold cathode will be accumulated on the insulating layer to charge the insulating layer 2, which may cause an adverse effect against the function of the field emission cold cathode.

Although a conductive substrate is used in the above-described embodiments of the present invention, an insulating substrate covered by a conductive layer may be used as a substrate for the field emission cold cathode of the present invention.

Further, although the present invention is described with reference to the preferred embodiments, the present invention is not limited to such embodiments and it will be obvious for those skilled in the art that various modifications or alterations can be easily made based on the above embodiments within the scope of the present invention.

What is claimed is:

1. A field emission cold cathode comprising:

a substrate having at least one electrically-conductive surface;

an insulating layer formed on said electrically-conductive surface of said substrate, said insulating layer having a uniform thickness and having a cavity defined by a cavity edge formed therein;

a gate electrode having an annular portion formed on said insulating layer adjacent said cavity edge, an elevated middle portion spaced apart from said insulating layer to define a gap therebetween so that a low parasitic capacitance is provided, and a peripheral portion formed on said insulating layer; and an emitter disposed in said cavity, said emitter being electrically connected to said electrically-conductive surface of said substrate and having an emission tip disposed adjacent to said annular portion of said gate electrode.

2. A field emission cold cathode as defined in claim 1, wherein said gate electrode is formed on a peripheral portion of said insulating layer.

3. A field emission cold cathode as defined in claim 1, wherein said elevated middle portion has at least one cut-out formed therein.

4. A field emission cold cathode as defined in claim 1, further comprising a gap insulating layer formed on said insulating layer and disposed in said gap between said insulating layer and said elevated middle portion of said gate electrode.

5. A field emission cold cathode as defined in claim 1, wherein said substrate is made of monocrystalline silicon.

* * * * *